US005308410A

United States Patent [19]

Horimura et al.

[11] Patent Number: 5,308,410

[45] Date of Patent: May 3, 1994

[54] PROCESS FOR PRODUCING HIGH STRENGTH AND HIGH TOUGHNESS ALUMINUM ALLOY

[75] Inventors: Hiroyuki Horimura; Kenji Okamoto; Noriaki Matsumoto; Masao Ichikawa, all of Saitama, Japan

[73] Assignee: Honda Giken Kogyo Kabushiki Kaisha, Tokyo, Japan

[21] Appl. No.: 896,823

[22] Filed: Jun. 11, 1992

[51] Int. Cl.[5] ..... C22C 45/08

[52] U.S. Cl. ..... 148/561; 148/698; 148/699

[58] Field of Search ..... 148/561, 688, 698, 699; 75/249

[56] References Cited

U.S. PATENT DOCUMENTS 4,347,076 8/1982 Ray et al. ..... 75/249
4,715,893 12/1987 Skinner et al. ..... 75/249
4,743,317 5/1988 Skinner et al. ..... 75/249
5,000,781 3/1991 Skinner et al. ..... 75/249

*Primary Examiner*—George Wyszomierski
*Attorney, Agent, or Firm*—Lyon & Lyon

[57] ABSTRACT

A process for producing an aluminum alloy with high strength and toughness includes the steps of: preparing an alloy blank having a primary structure which is one selected from a single-phase structure comprised of a solid-solution phase, a single-phase structure comprised of an amorphous phase, and a mixed-phase structure comprised of a solid-solution phase and an amorphous phase, and subjecting the alloy blank to a thermal treatment to provide an aluminum alloy which has a secondary structure containing 20% or more by volume fraction Vf of chrysanthemum-like patterned phases each having a diameter of at most 5 μm and comprising a solid-solution phase and an intermetallic compound phase arranged radiately.

5 Claims, 10 Drawing Sheets

500nm

PROCESS FOR PRODUCING HIGH STRENGTH AND HIGH TOUGHNESS ALUMINUM ALLOY

BACKGROUND OF THE INVENTION

1. Field of the Invention

The present invention relates to a process for producing a high strength and high toughness aluminum alloy.

2. Description of the Prior Art

There are conventionally known quenching and solidifying processes described in Japanese Patent Application Laid-open No. 248860/85, as a process of producing such alloys.

The above prior art process can produce an aluminum alloy having a micro-eutectic crystal structure. However, this aluminum alloy can possess relatively low strength and toughness due to a partial change and a coalescence of the metallographic structure which can be caused by a service environment, a thermal hysteresis during hot plastic working, and the like.

SUMMARY OF THE INVENTION

It is an object of the present invention to provide an aluminum alloy producing process of the type described above wherein an aluminum alloy with an increased strength and an increased toughness can be produced.

To achieve the above object, according to the present invention, there is provided a process for producing an aluminum alloy with a high strength and a high toughness, comprising the steps of: preparing an alloy blank having a primary structure which is one selected from a single-phase structure comprised of a solid-solution phase, a single-phase structure comprised of an amorphous phase, and a mixed-phase structure comprised of a solid-solution phase and an amorphous phase, and subjecting the alloy blank to a thermal treatment to provide an aluminum alloy which has a secondary structure containing 20% or more by volume fraction Vf of chrysanthemum-like patterned phases each having a diameter of at most 5 μm and comprising a solid-solution phase and an intermetallic compound phase arranged radiately.

In this way, an aluminum alloy with a high strength and a high toughness can be produced by subjecting an alloy blank having a particular primary structure of the type described above to a thermal treatment to form a secondary structure of the type described above.

This alloy is useful as a metal material for a high strength structural member, because the change in metallographic structure under a thermal hysteresis is small.

If the diameter of the mentioned chrysanthemum-like patterned phase in the obtained aluminum alloy exceeds 5 μm, the hardness of the aluminum alloy is reduced, resulting in a deteriorated strength. On the other hand, if the volume fraction Vf of the chrysanthemum-like patterned phase is less than 20%, the strain at fracture of the aluminum alloy is reduced, resulting in a deteriorated toughness.

The above and other objects, features and advantages of the invention will become apparent from the following description of the preferred embodiments, taken in conjunction with the accompanying drawings.

DESCRIPTION OF THE PREFERRED EMBODIMENTS

Figure 1:
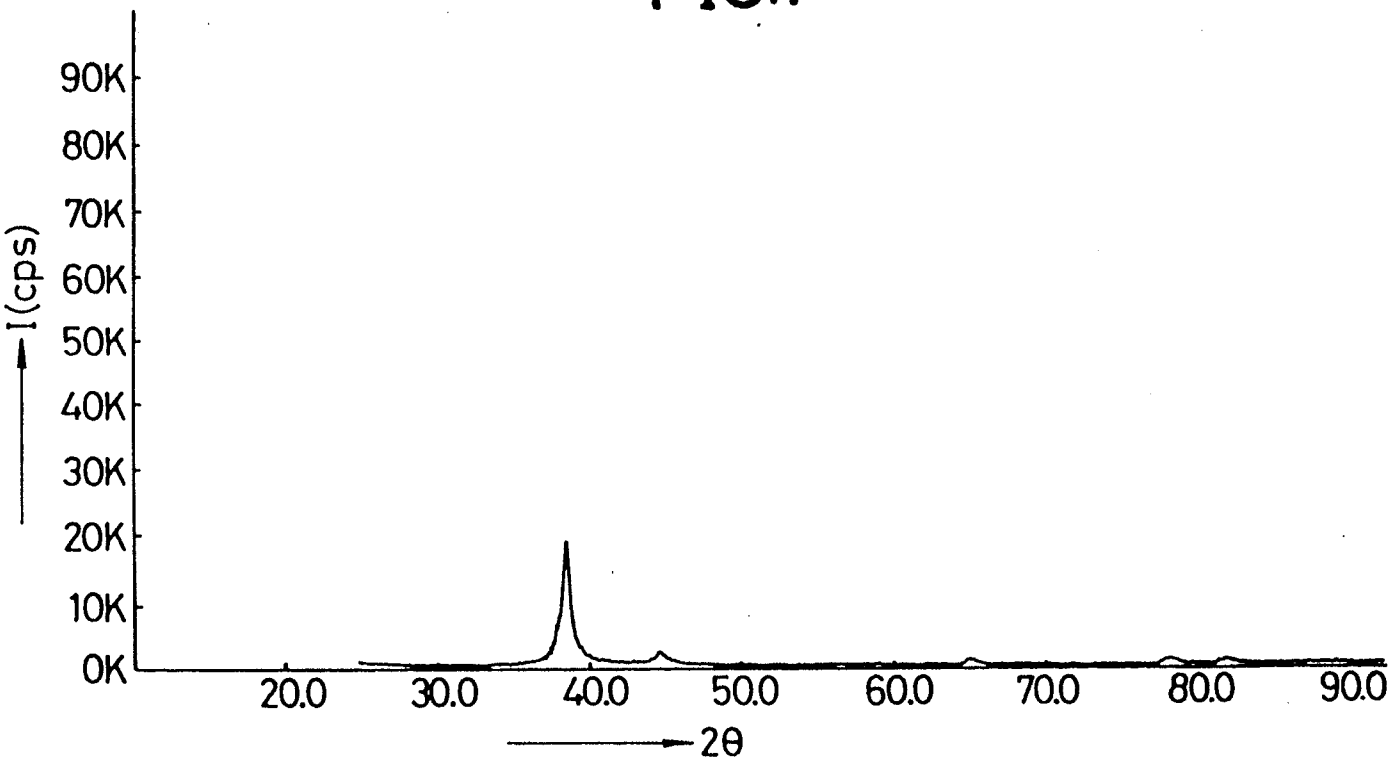
FIG. 1 is an X-ray diffraction pattern diagram for an alloy blank.

In producing an aluminum alloy with a high strength and a high toughness, a process is carried out which comprises the steps of preparing an alloy blank having a primary structure that is one selected from a single-phase structure comprised of a solid-solution phase, e.g., an fcc phase (a face-centered cubic structure), a single-phase structure comprised of an amorphous phase, and a mixed-phase structure comprised of an fcc phase and an amorphous phase, and then subjecting the alloy blank to a thermal treatment to provide an aluminum alloy which has a secondary structure containing 20% or more by volume fraction Vf of chrysanthemum-like patterned phases each having a diameter of at most 5 μm and comprising an fcc phase and an intermetallic compound phase arranged radiately.

Materials for forming the alloy blank include, for example, the following four types of materials:

A first type of a material is represented by a chemical formula: $Al_aX_bT_c$ wherein X is at least one element selected from a first group including Fe, Co, Ni and Cu; T is at least one element selected from a second group including Y, rare earth elements, Zr, Ti, Mm (misch metal) and Ca; and each of a, b and c are atomic precentages, with the proviso that $85 \leqq a \leqq 96$, $1 < b \leqq 12$, and $1 < c \leqq 10$.

A second type of a material is represented by a chemical formula: $Al_aX_bT_cZ_d$ wherein X is at least one element selected from the first group including Fe, Co, Ni and Cu; T is at least one element selected from the second group including Y, rare earth elements, Zr, Ti, Mm (misch metal) and Ca; Z is at least one element selected from a third group including V, Cr, Mn, Nb and Mo; and each of a, b, c and d are atomic percentages, with the proviso that $85 \leqq a \leqq 96$, $1 < b \leqq 12$, $1 < c \leqq 10$, and $d \leqq 3$.

A third type of a material is represented by a chemical formula: $Al_aX_bT_aSi_e$ wherein X is at least one element selected from the first group including Fe, Co, Ni and Cu; T is at least one element selected from the second group including Y, rare earth elements, Zr, Ti, Mm (misch metal) and Ca; and each of a, b, c and e are atomic precentages, with the proviso that $85 \leqq a \leqq 96$, $1 < b \leqq 12$, $1 < c \leqq 10$, and $e \leqq 4$.

A fourth type of a material is represented by a chemical formula: $Al_aX_bT_cZ_dSi_e$ wherein X is at least one element selected from the first group including Fe, Co, Ni and Cu; T is at least one element selected from the second group including Y, rare earth elements, Zr, Ti, Mm (misch metal) and Ca; Z is at least one element selected from a third group including V, Cr, Mn, Nb and Mo; and each of a, b, c, d and e are atomic precentages, with the proviso that $85 \leqq a \leqq 96$, $1 < b \leqq 12$, $1 < c \leqq 10$, $d \leqq 3$, and $e \leqq 4$.

In each of the third and fourth types of the materials for forming the aluminum alloy blank, Si has an effect to improve the amorphous-phase forming ability to facilitate production of the first structure, and at the same time to improve the characteristics of the aluminum alloy by formation of an intermetallic compound containing Si during a thermal treatment. However, if Si > 4 atomic %, such effect is reduced.

In producing the alloy blank, a liquid quenching process, e.g., a single-roll process is applied.

The thermal treatment is carried out at a temperature in a range below destruction temperatures of the single-phase and mixed-phase structures. If the thermal treatment is conducted at a temperature exceeding such destruction temperature, the nonuniformity and coalescence of the secondary structure may be caused and hence, such a temperature is not preferred.

A particular example will be described below.

A molten base alloy having a composition represented by $Al_{92}Fe_4Y_3Mn_1$ (each of numerical values are atomic precentages) was first prepared through an arc melting, and then, a ribbon-shaped alloy blank having a width of about 2 mm and a thickness of about 20 μm was produced by application of a single-roll process.

The conditions for the single-roll process were as follows: the speed of rotation of a copper rotary roll having a diameter of 20 mm was 4,000 rpm; the diameter of an injection opening in a quartz nozzle was 0.5 mm; the molten metal injection pressure was 0.4 kgf/cm$_2$; the gap between the quartz nozzle and the rotary roll was 0.3 mm; and an argon atmosphere at −40 cmHg was used.

FIG. 1 is an X-ray diffraction pattern diagram for the alloy blank; A peak has appeared due to the fcc phase in the diagram. Therefore, it can be seen that the primary structure of the alloy blank is a mixed-phase structure comprising the fcc phase and the amorphous phase.

Figure 2:
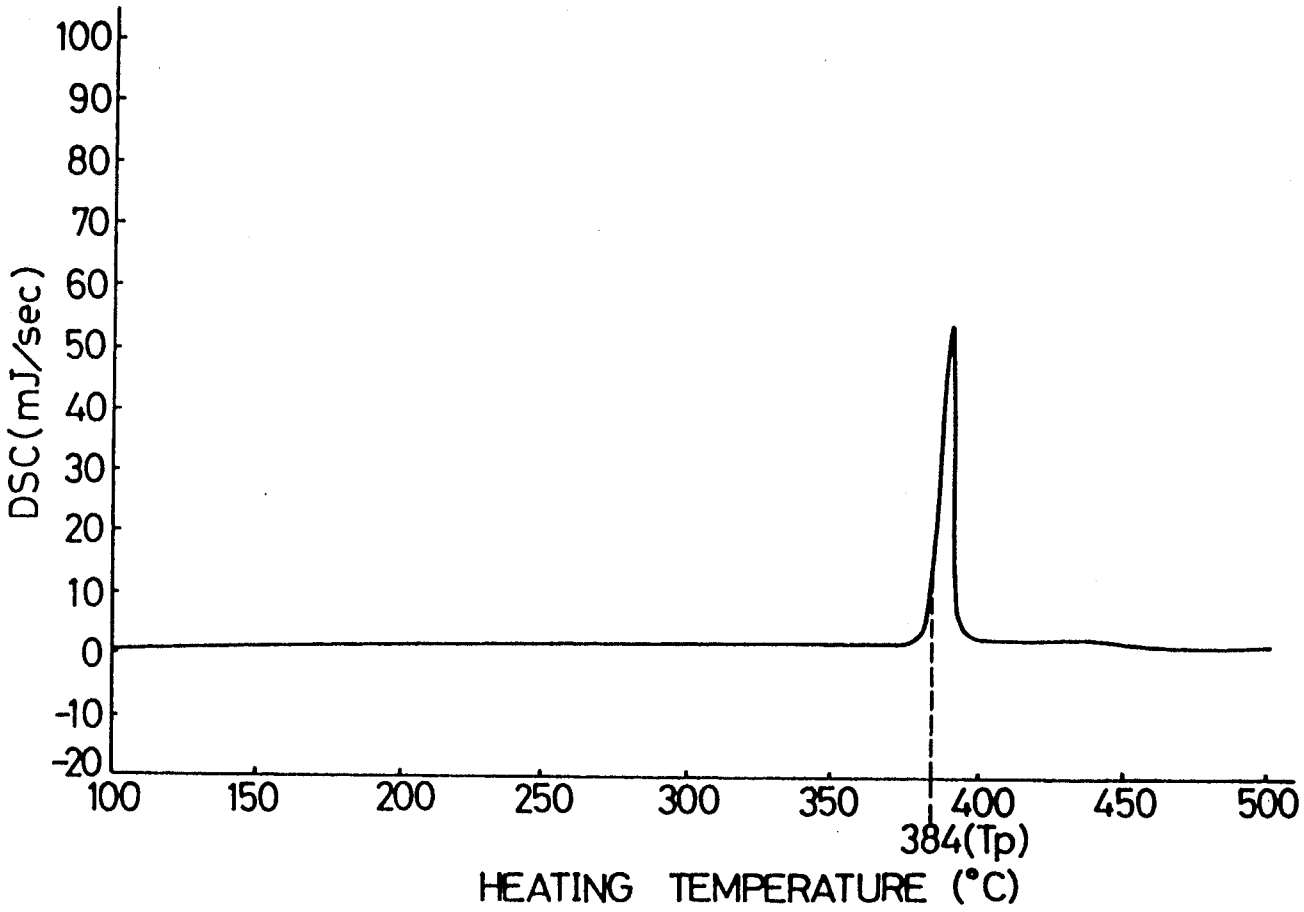
FIG. 2 is a thermocurve diagram of a differential thermal analysis for the alloy blank.

FIG. 2 is a thermocurve diagram of a differential thermal analysis for the alloy blank. The destruction temperature Tp of the mixed-phase structure in this alloy blank is 384° C. The exothermic calorie resulting from the destruction is 85.97 J/g. At the above-described destruction temperature, the mixed-phase structure is destructed, and an intermetallic compound is precipitated.

Then, the alloy blank was cut into a length of about 5 cm and placed into quartz under vacuum pressure, and then subjected to a thermal treatment.

Figure 3:
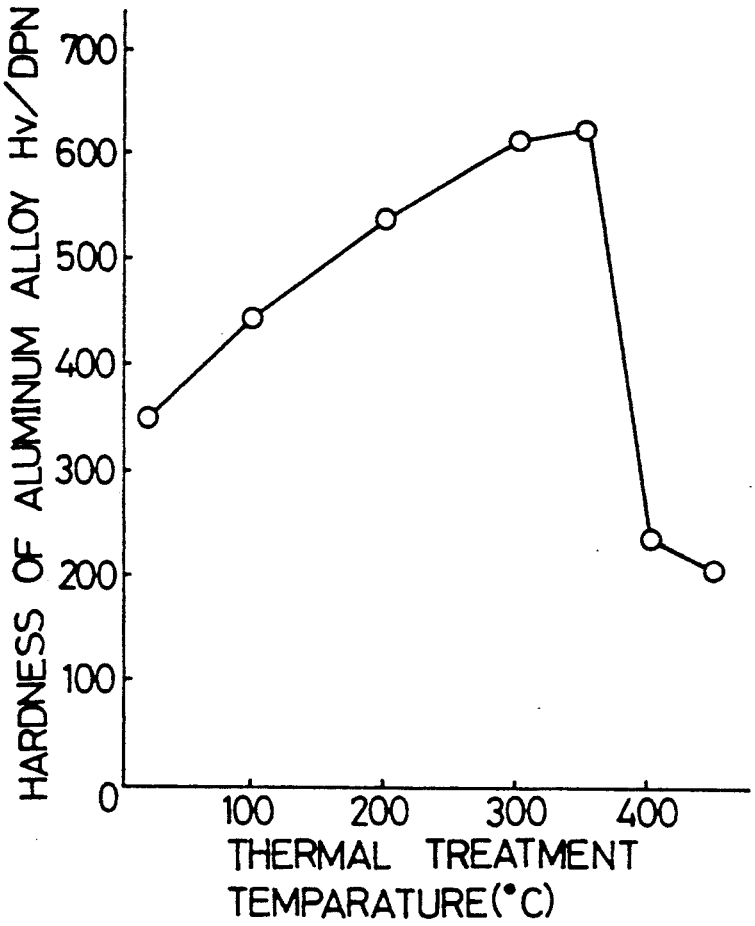
FIG. 3 is a graph illustrating the relationship between the thermal treatment temperature and the hardness of an aluminum alloy.

FIG. 3 illustrates the relationship between the thermal treatment temperature and the hardness of the aluminum alloy. The thermal treatment time was one hour. In the thermal treatment, the temperature of the alloy blank reached the thermal treatment temperature within one minute after placing the alloy blank into the furnace.

As is apparent from FIG. 3, at a thermal treatment temperature equal to or lower than 350° C., the hardness of the aluminum alloy is increased because the amorphous phase has crystallized into the fcc phase, but at a thermal treatment temperature exceeding 350° C., an intermetallic compound phase appears, and at the same time, the hardness of the aluminum alloy is remarkably reduced.

Each of FIGS. 4 to 7 is a transmission-type electron photomicrograph showing a metallographic structure (secondary structure) of each of aluminum alloys $A_1$ to $A_4$ obtained through a thermal treatment.

The conditions for the thermal treatment are as given in Table 1. In the thermal treatment, the temperature of the alloy blank reached the thermal treatment temperature within one minute after placing the alloy blank into the furnace.

TABLE 1

| Aluminum alloy | Thermal treatment condition | |
|---|---|---|
| | Temperature (°C.) | Time (hr.) |
| $A_1$ | 350 | 1 |
| $A_2$ | 350 | 3 |
| $A_3$ | 350 | 10 |
| $A_4$ | 350 | 30 |

Figure 4:
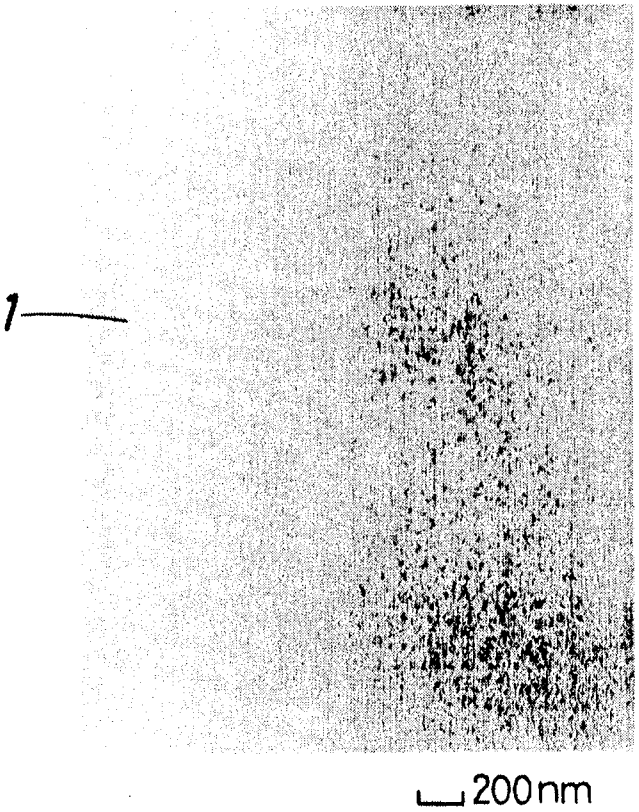
FIG. 4 is a photomicrograph showing a metallographic structure of an aluminum alloy resulting from a thermal treatment for one hour.
Figure 8:
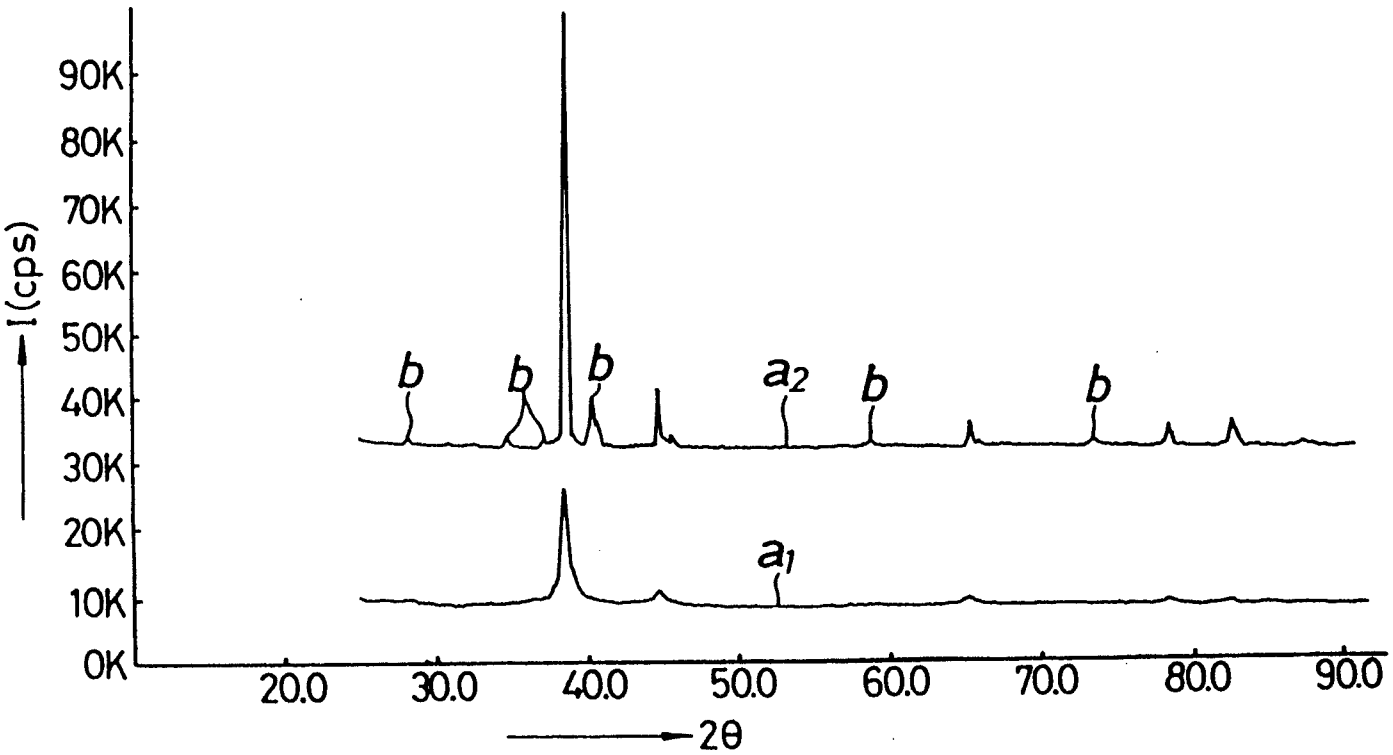
FIG. 8 is an X-ray diffraction pattern diagram for an aluminum alloy.

In the aluminum alloy $A_1$ shown in FIG. 4, the destruction of the mixed-phase structure 1 was little produced, because of a short thermal treatment time. This is also evident from the fact that no peak for an intermetallic compound appeared in the X-ray diffraction pattern diagram for the aluminum alloy $A_1$ shown by the line $a_1$ in FIG. 8.

Figure 5:
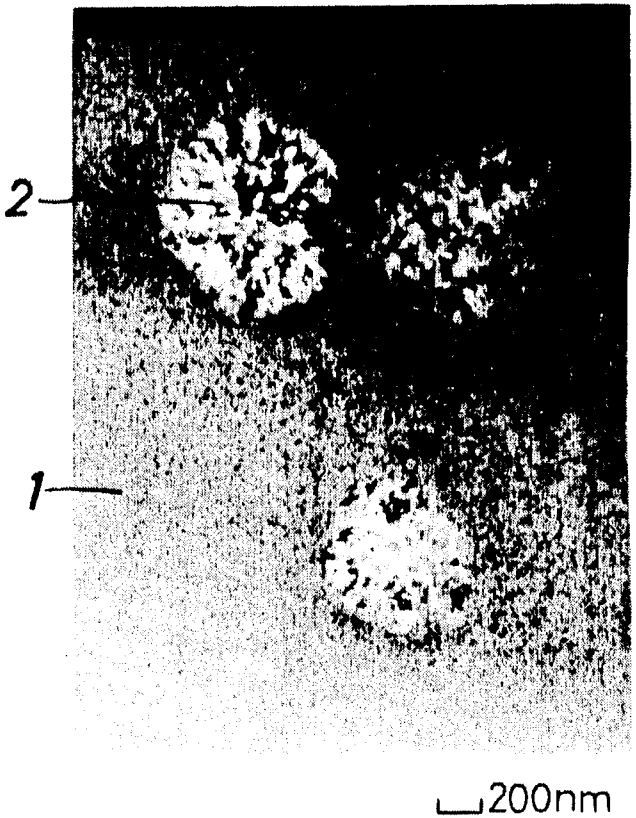
FIG. 5 is a photomicrograph showing the metallographic structure of an aluminum alloy resulting from a thermal treatment for three hours.

In the aluminum alloy $A_2$ shown in FIG. 5, a chrysanthemum-like patterned phase 2 is precipitated in the mixed-phase structure 1 and is in the form comprising an fcc phase and an intermetallic compound phase arranged radiately. This is also evident from the appearance of peaks b characterizing intermetallic compounds in the X-ray diffraction pattern diagram for the aluminum alloy $A_2$ shown by the line $a_2$ in FIG. 8. The intermetallic compounds are, for example, represented by $Al_3Y$ based, Al-Fe based, Al-Mn based and Al-Fe-Y based intermetallic compounds and the like.

Figure 6:
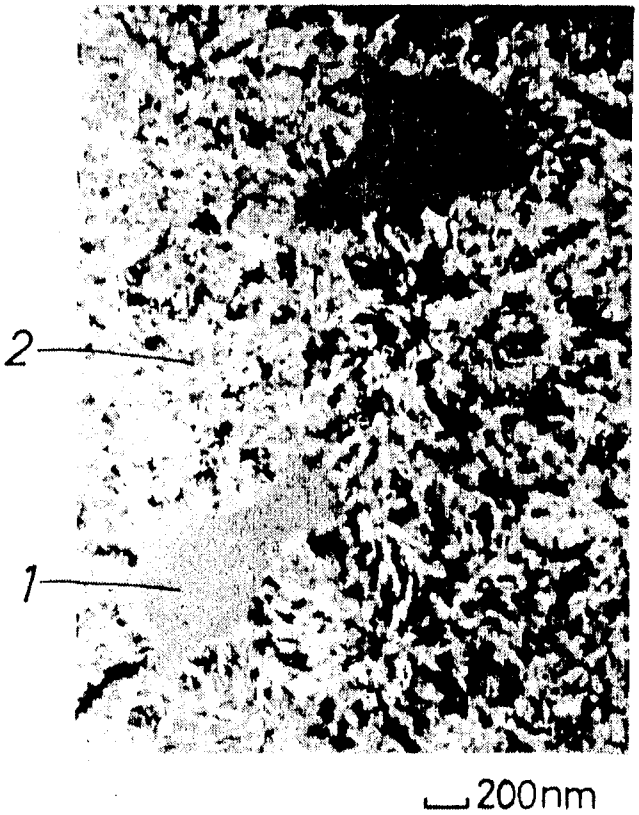
FIG. 6 is a photomicrograph showing a metallographic structure of an aluminum alloy resulting from a thermal treatment for ten hours.

In the aluminum alloy $A_3$ shown in FIG. 6, a chrysanthemum-like patterned phase 2 occupies an increased area, and a mixed-phase structure 1 exists in a decreased area. The diameter of the chrysanthemum-like patterned phase 2 is 1.1 μm.

Figure 7:
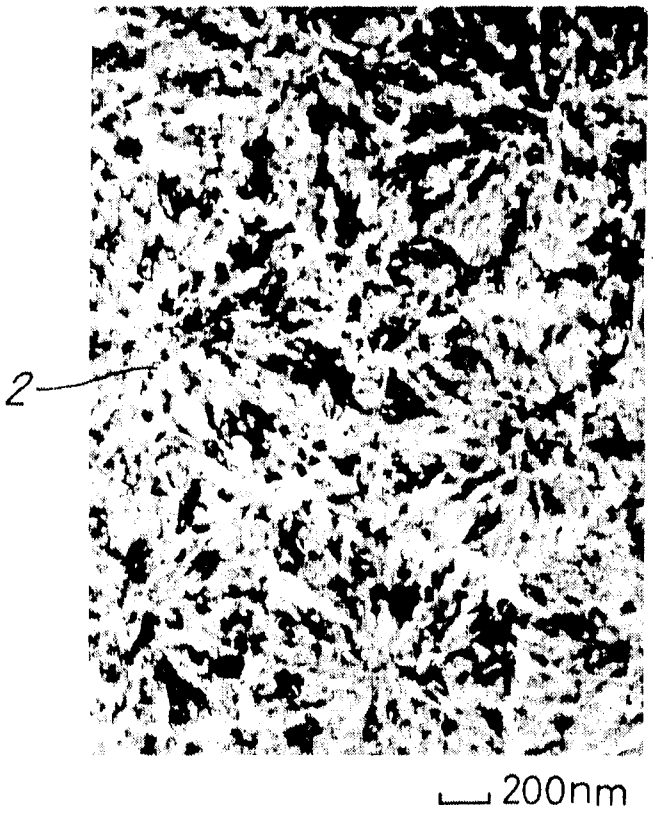
FIG. 7 is a photomicrograph showing a metallographic structure of an aluminum alloy resulting from a thermal treatment for thirty hours.

In the aluminum alloy $A_4$ shown in FIG. 7, the secondary structure thereof comprises mostly a chrysanthemum-like patterned phase 2. The diameter of the chrysanthemum-like patterned phase 2 alone is 1.2 μm.

It can be seen from the phase change in FIGS. 4 to 7 that the production of nucleus is rapid, but the rate of growth of the chrysanthemum-like patterned phase 2 is low.

Table 2 illustrates the relationship between the exothermic calorie in the differential thermal analysis and the volume fraction Vf of the chrysanthemum-like patterned phase for the aluminum alloys $A_1$ to $A_4$. The volume fraction Vf was determined by comparing the exothermic calories before and after thermal treatment of the aluminum alloys.

TABLE 2

| Aluminum alloy | Exothermic calorie (J/g) | Volume fraction of chrysanthemum-like patterned phase Vf (%) |
|---|---|---|
| $A_1$ | 82.2 | <5 |
| $A_2$ | 71.5 | 17 |
| $A_3$ | 14.5 | 83 |
| $A_4$ | <1 | >98 |

Figure 9:
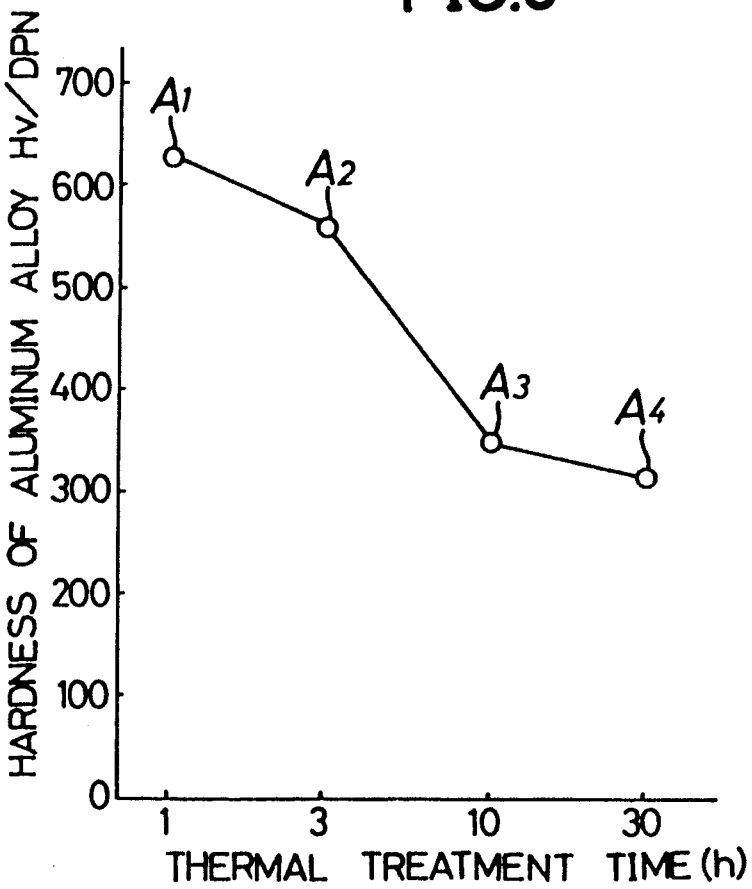
FIG. 9 is a graph illustrating the relationship between the thermal treatment time and the hardness of the aluminum alloy.

FIG. 9 illustrates the relationship between the thermal treatment time and the hardness of each of the aluminum alloys. In FIG. 9, points $A_1$ to $A_4$ correspond to the aluminum alloys $A_1$ to $A_4$, respectively.

As is apparent from FIGS. 4 to 7 and 9 and Table 2, the hardness of the aluminum alloy reduces as the chrysanthemum-like patterned phase increases, but the aluminum alloys $A_3$ and $A_4$ maintain a hardness and thus a strength sufficient for a metal material for a structural member. In other words, the strength of the aluminum alloy can be improved by setting the diameter of the chrysanthemum-like patterned phase in the secondary structure of the aluminum alloy at a value of at most 5 μm, and the volume fraction thereof at a value at least 20%.

Figure 10:
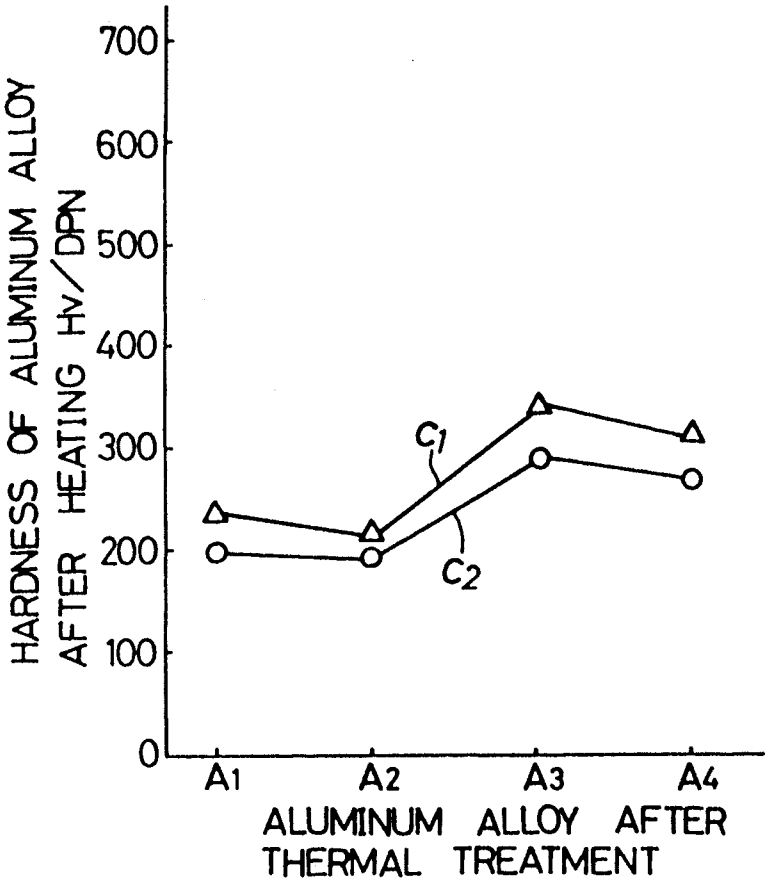
FIG. 10 is a graph illustrating the change in hardness when various aluminum alloys were heated after the thermal treatment.

FIG. 10 illustrates the hardness of the aluminum alloys $A_1$ to $A_4$ after the thermal treatment, when they have been heated for one hour at 385° C. and 400° C. This experiment was carried out on the assumption of application of a plastic working to the aluminum alloys. In FIG. 10, the line $c_1$ corresponds to the case of the heating temperature of 385° C., and the line $c_2$ corresponds to the case of the heating temperature of 400° C.

As is apparent from FIG. 10, it can be seen that each of the aluminum alloys $A_3$ and $A_4$ having the secondary structure whose chrysanthemum-like patterned phase has a diameter of at most 5 μm and a volume fraction of at least 20% maintains a high hardness even after the heating and therefore, a high strength is provided.

It is believed that this is because the growth of the chrysanthemum-like patterned phase is slow due to a strain accumulated in an interface of the chrysanthemum-like patterned phase, if the aluminum alloy has a secondary structure of the type described above. This enables a production of a high strength structural member which has a uniform metallographic structure whose coalescence is suppressed. From a viewpoint of an increase in strength, it is desirable that the particle diameter of crystal grains in the metallographic structure of a structural member is at most 10 μm.

In each of the aluminum alloys $A_1$ and $A_2$ having the secondary structure whose chrysanthemum-like patterned phase has a volume fraction Vf less than 20%, the mixed-phase structure is destructed rapidly during the above-described heating, and a large amount of exothermic is involved, thereby bringing about a nonuniformity and a coalescence of the metallographic structure, resulting in a reduced strength.

Figure 11:
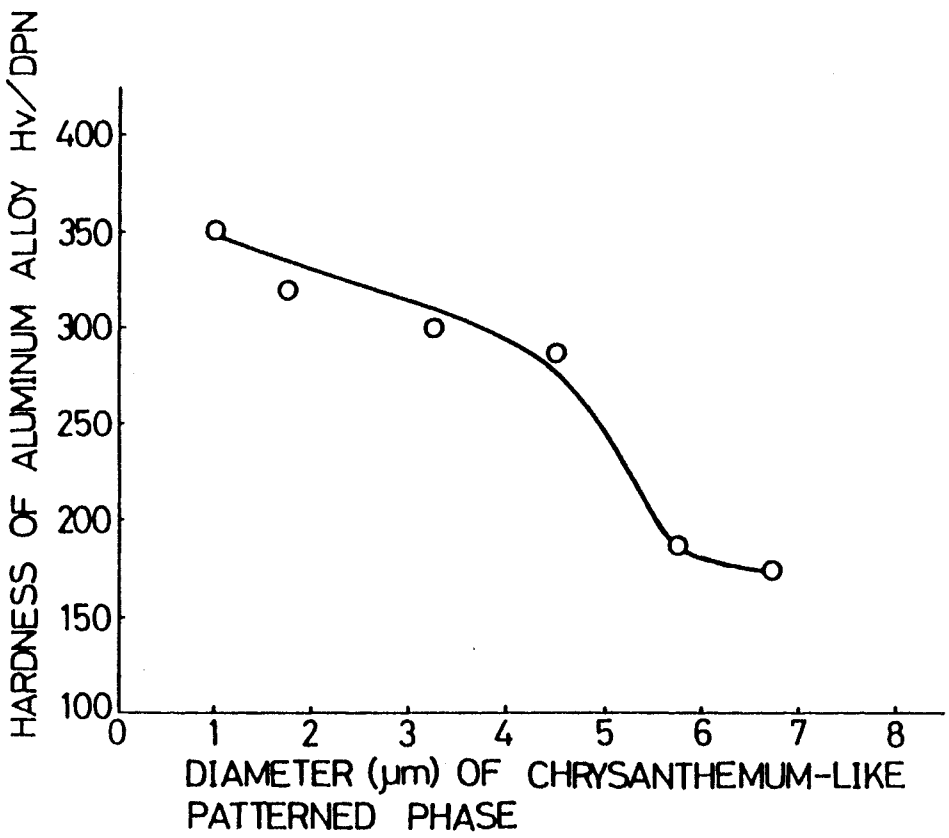
FIG. 11 is a graph illustrating the relationship between the diameter of the chrysanthemum-like patterned phase and the hardness of the aluminum alloy.

FIG. 11 illustrates the relationship between the diameter of the chrysanthemum-like patterned phase and the hardness of the aluminum alloy whose chrysanthemum-like patterned phase has a volume fraction Vf of at least 80%.

It is apparent from FIG. 11 that if the diameter of the chrysanthemum-like patterned phase is at most 5 μm, strength of the aluminum alloy can be improved.

Figure 12:
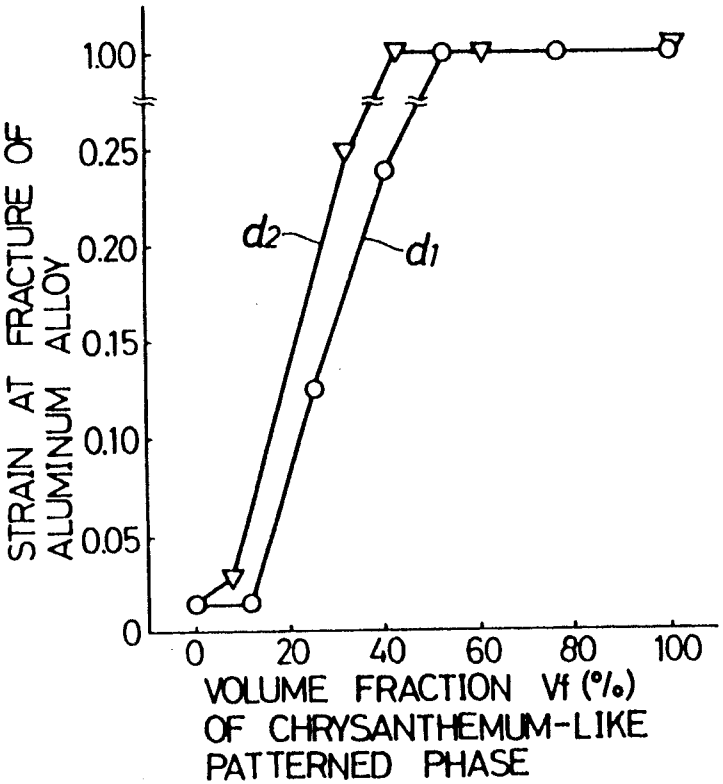
FIG. 12 is a graph illustrating the relationship between the volume fraction of the chrysanthemum-like patterned phase and the strain of the aluminum alloy.

FIG. 12 illustrates the relationship between the volume fraction Vf of the chrysanthemum-like patterned phase and the strain at fracture of the aluminum alloy. In FIG. 12, the line $d_1$ corresponds to the case where the diameter of the chrysanthemum-like patterned phase is about 1 μm, and the line $d_2$ corresponds to the case where the diameter of the chrysanthemum-like patterned phase is about 3 μm.

As is apparent from the lines $d_1$ and $d_2$, the results of a bending test for the aluminum alloy shows that an improvement in toughness is provided by setting the volume fraction Vf of the chrysanthemum-like patterned phase at least at 20%, and a bond bending through 180° is made possible by setting the volume fraction Vf of the chrysanthemum-like patterned phase at a level in a range of 40 to 50%.

Figure 13:
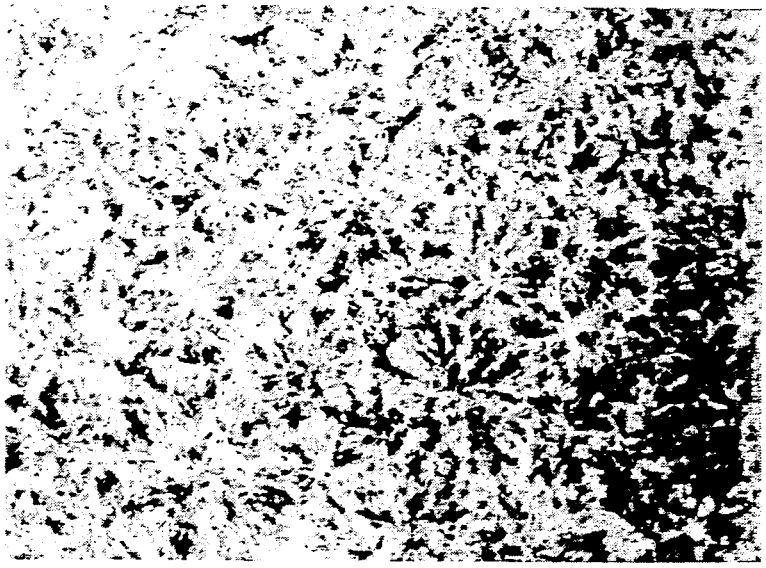
FIG. 13 is a photomicrograph showing a metallographic structure of the aluminum alloy.

FIG. 13 is a transmission type electron photomicrograph showing the metalographic structure of an aluminum alloy produced by subjecting an alloy blank having the same composition ($Al_{92}Fe_4Y_3Mn_1$) as that described above and a volume fraction of 20% of an fcc phase to a thermal treatment for one hour at 360° C.

The secondary structure of this alloy is formed by a uniform chrysanthemum-like patterned phase. In order to provide a uniform chrysanthemum-like patterned phase, it is necessary for the volume fraction of the fcc phase in the alloy blank to be at least 5% before a chrysanthemum-like patterned phase appears. It is believed that this is because the fcc phase functions as a nucleus for the chrysanthemum-like patterned phase.

Figure 14:
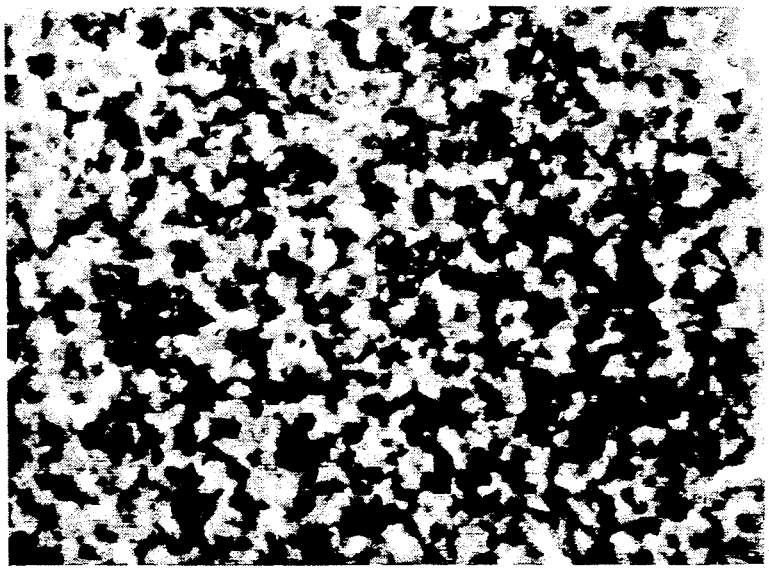
FIG. 14 is a photomicrograph showing the metallographic structure of an aluminum alloy as a comparative example.

FIG. 14 is a transmission type electron photomicrograph showing the metalographic structure of an aluminum alloy as a comparative example produced by a thermal treatment of the above-described alloy blank under conditions of 400° C. and one hour.

It can be seen from FIG. 14 that the secondary structure is formed by a relatively large grain texture, and this shows that a coalescence of the structure has occured.

The compositions of various alloy blanks, the thermal treatment conditions for producing aluminum alloys, the characteristics of aluminum alloys, etc., are given in the Tables below. In each of the Tables, the same numbers are used for convenience to designate the alloy blanks and the aluminum alloys produced therefrom. Each of the single-phase structures in Tables 3, 5, 7 and 9 are comprised of an amorphous phase.

(a) Al-Fe-Y Based Alloy (Tables 3 and 4)

TABLE 3

| Alloy blank | Composition (atomic %) Al | Fe | Y | Primary structure | Destruction temperature (°C.) |
|---|---|---|---|---|---|
| (1) | 98 | 1 | 1 | — | — |
| (2) | 96 | 2 | 2 | mixed-phase | 380 |
| (3) | 94 | 1 | 5 | mixed-phase | 383 |
| (4) | 94 | 2 | 4 | mixed-phase | 383 |
| (5) | 94 | 3 | 3 | mixed-phase | 383 |
| (6) | 94 | 4 | 2 | mixed-phase | 385 |
| (7) | 94 | 5 | 1 | mixed-phase | 380 |
| (8) | 92 | 3 | 5 | mixed-phase | 374 |
| (9) | 92 | 4 | 4 | mixed-phase | 385 |
| (10) | 92 | 5 | 3 | mixed-phase | 385 |
| (11) | 90 | 5 | 5 | single-phase | 385 |

TABLE 3-continued

| Alloy blank | Composition (atomic %) Al | Fe | Y | Primary structure | Destruction temperature (°C.) |
|---|---|---|---|---|---|
| (12) | 85 | 7.5 | 7.5 | single-phase | 373 |

TABLE 4

| Alumi-num alloy | T.T. Cond. Tem. (°C.) | Time (hr) | C.C. phase Dia. (μm) | Vf (%) | Har. (Hv/DPN) | Ben. (≧0.1) | Es-tima-tion |
|---|---|---|---|---|---|---|---|
| (1) | — | — | — | — | — | — | failure |
| (2) | 350 | 1 | 3.0 | 60 | 162 | possible | good |
| (3) | 350 | 1 | 6.8 | 100 | 122 | possible | failure |
| (4) | 350 | 1 | 3.2 | 80 | 173 | possible | good |
| (5) | 350 | 1 | 2.7 | 70 | 194 | possible | good |
| (6) | 350 | 1 | 2.5 | 70 | 201 | possible | good |
| (7) | 350 | 1 | 2.1 | 60 | 200 | possible | slightly good |
| (8) | 350 | 1 | 2.2 | 100 | 198 | possible | good |
| (9) | 350 | 1 | 1.8 | 100 | 220 | possible | good |
| (10) | 350 | 1 | 1.3 | 100 | 252 | possible | good |
| (11) | 350 | 1 | 1.1 | 80 | 272 | possible | good |
| (12) | 350 | 1 | 1.0 | 80 | 300 | possible | good |

T.T. Cond. = Thermal treatment condition
C.C. phase = Chrysanthemum-like patterned phase
Har. = Hardness
Ben. = Bending
Tem. = Temperature
Dia. = Diameter
Vf = Volume fraction (b) Al-Ni-Y Based Alloy (Tables 5 and 6)

TABLE 5

| Alloy blank | Composition (atomic % m) Al | Ni | Y | Primary structure | Destruction temperature (°C.) |
|---|---|---|---|---|---|
| (13) | 91 | 3 | 6 | mixed-phase | 315 |
| (14) | 87 | 10 | 3 | mixed-phase | 316 |
| (15) | 85 | 7.5 | 7.5 | mixed-phase | 317 |
| (16) | 85 | 5 | 10 | single-phase | 282 |

TABLE 6

| Alumi-num alloy | T.T. Cond. Tem. (°C.) | Time (hr) | C.C. phase Dia. (μm) | Vf (%) | Har. (Hv/DPN) | Ben. (≧0.1) | Es-tima-tion |
|---|---|---|---|---|---|---|---|
| (13) | 280 | 1 | 3.2 | 80 | 180 | possible | good |
| (14) | 280 | 1 | 2.1 | 80 | 242 | possible | good |
| (15) | 280 | 1 | 1.5 | 80 | 247 | possible | good |
| (16) | 250 | 1 | 1.5 | 80 | 240 | possible | good |

T.T. Cond. = Thermal treatment condition
C.C. phase = Chrysanthemum-like patterned phase
Har. = Hardness
Ben. = Bending
Tem. = Temperature
Dia. = Diameter
Vf = Volume fraction (c) Al-Ni-Ce Based Alloy (Tables 7 and 8)

TABLE 7

| Alloy blank | Composition (atomic %) Al | Ni | Ce | Primary structure | Destruction temperature (°C.) |
|---|---|---|---|---|---|
| (17) | 93 | 3 | 4 | mixed-phase | 322 |
| (18) | 87 | 10 | 3 | mixed-phase | 342 |
| (19) | 85 | 7.5 | 7.5 | mixed-phase | 301 |

TABLE 8

| Alumi-num alloy | T.T. Cond. Tem. (°C.) | Time (hr) | C.C. phase Dia. (μm) | Vf (%) | Har. (Hv/DPN) | Ben. (≧0.1) | Es-tima-tion |
|---|---|---|---|---|---|---|---|
| (17) | 290 | 1 | 3.0 | 80 | 190 | possible | good |
| (18) | 310 | 1 | 2.3 | 80 | 248 | possible | good |
| (19) | 270 | 1 | 1.3 | 80 | 252 | possible | good |

T.T. Cond. = Thermal treatment condition
C.C. phase = Chrysanthemum-like patterned phase
Har. = Hardness
Ben. = Bending
Tem. = Temperature
Dia. = Diameter
Vf = Volume fraction (d) Al-Ni-Mm Based Alloy (Tables 9 and 10)

TABLE 9

| Alloy blank | Composition (atomic %) Al | Ni | Mm | Primary structure | Destruction temperature (°C.) |
|---|---|---|---|---|---|
| (20) | 92.5 | 5 | 2.5 | mixed-phase | 338 |
| (21) | 90 | 5 | 5 | mixed-phase | 335 |
| (22) | 87.5 | 5 | 7.5 | single-phase | 313 |
| (23) | 85 | 5 | 10 | single-phase | 316 |

TABLE 10

| Alumi-num alloy | T.T. Cond. Tem. (°C.) | Time (hr) | C.C. phase Dia. (μm) | Vf (%) | Har. (Hv/DPN) | Ben. (≧0.1) | Es-tima-tion |
|---|---|---|---|---|---|---|---|
| (20) | 310 | 1 | 2.0 | 80 | 216 | possible | good |
| (21) | 300 | 1 | 1.8 | 80 | 230 | possible | good |
| (22) | 280 | 1 | 1.5 | 80 | 247 | possible | good |
| (23) | 280 | 1 | 1.5 | 80 | 259 | possible | good |

T.T. Cond. = Thermal treatment condition
C.C. phase = Chrysanthemum-like patterned phase
Har. = Hardness
Ben. = Bending
Tem. = Temperature
Dia. = Diameter
Vf = Volume fraction (e) Al-X-T Based Alloy (Tables 11 and 12)

TABLE 11

| Alloy blank | Composition (atomic %) Al | Co | Cu | Ni | Y | Ca | Zr | Ti | Primary structure | Des. Tem. (°C.) |
|---|---|---|---|---|---|---|---|---|---|---|
| (24) | 87 | 10 | — | — | 3 | — | — | — | mixed-phase | 270 |
| (25) | 87 | — | 3 | — | 10 | — | — | — | mixed-phase | 261 |
| (26) | 85 | — | — | 10 | — | 5 | — | — | mixed-phase | 312 |
| (27) | 87 | — | — | 8 | — | — | 5 | — | mixed-phase | 350 |
| (28) | 85 | — | — | 10 | — | — | — | 5 | mixed-phase | 344 |

Des. Tem. = Destraction temperature

TABLE 12

| Alumi-num alloy | T.T. Cond. Tem. (°C.) | Time (hr) | C.C. phase Dia. (μm) | Vf (%) | Har. (Hv/DPN) | Ben. (≧0.1) | Es-tima-tion |
|---|---|---|---|---|---|---|---|
| (24) | 240 | 1 | 2.0 | 70 | 210 | possible | good |
| (25) | 230 | 1 | 3.7 | 80 | 196 | possible | good |
| (26) | 280 | 1 | 3.5 | 80 | 179 | possible | good |
| (27) | 320 | 1 | 2.0 | 70 | 200 | possible | good |
| (28) | 320 | 1 | 2.4 | 70 | 220 | possible | good |

T.T. Cond. = Thermal treatment condition
C.C. phase = Chrysanthemum-like patterned phase
Har. = Hardness
Ben. = Bending
Tem. = Temperature
Dia. = Diameter
Vf = Volume fraction (f) Al-Fe-Y-Z Based Alloy (Tables 13 and 14)

TABLE 13

| Alloy blank | Composition (atomic %) Al | Fe | Y | Mn | Cr | Nb | V | Mo | Primary structure | Des. Tem. (°C.) |
|---|---|---|---|---|---|---|---|---|---|---|
| (29) | 92 | 4 | 3 | 1 | — | — | — | — | mixed-phase | 384 |
| (30) | 92 | 4 | 3 | — | 1 | — | — | — | mixed-phase | 387 |
| (31) | 92 | 4 | 3 | — | — | 1 | — | — | mixed-phase | 371 |
| (32) | 92 | 4 | 3 | — | — | — | 1 | — | mixed-phase | 378 |
| (33) | 92 | 4 | 3 | — | — | — | — | 1 | mixed-phase | 385 |
| (34) | 92 | 3 | 3 | 2 | — | — | — | — | mixed-phase | 381 |
| (35) | 92 | 2 | 3 | 3 | — | — | — | — | mixed-phase | 382 |
| (36) | 92 | 1 | 3 | 4 | — | — | — | — | mixed-phase | 379 |

Des. Tem. = Destruction temperature

TABLE 14

| Aluminum alloy | T.T. Cond. Tem. (°C.) | Time (hr) | C.C. phase Dia. (μm) | Vf (%) | Har. (Hv/DPN) | Ben. (≧0.1) | Estimation |
|---|---|---|---|---|---|---|---|
| (29) | 360 | 1 | 1.2 | 100 | 243 | possible | good |
| (30) | 360 | 1 | 1.2 | 100 | 238 | possible | good |
| (31) | 350 | 1 | 1.1 | 100 | 236 | possible | good |
| (32) | 350 | 1 | 1.1 | 100 | 240 | possible | good |
| (33) | 360 | 1 | 1.2 | 100 | 240 | possible | good |
| (34) | 360 | 1 | 1.0 | 80 | 247 | possible | good |
| (35) | 360 | 1 | 1.0 | 80 | 250 | possible | good |
| (36) | 360 | 1 | 2.1 | 60 | 315 | possible | slightly good |

T.T. Cond. = Thermal treatment condition
C.C. phase = Chrysanthemum-like patterned phase
Har. = Hardness
Ben. = Bending
Tem. = Temperature
Dia. = Diameter
Vf = Volume fraction (g) Al-Ni-Fe-Y-Ce Based Alloy (Tables 15 and 16)

TABLE 15

| Alloy blank | Composition (atomic %) Al | Ni | Fe | Y | Ce | Primary structure | Destruction temperature (°C.) |
|---|---|---|---|---|---|---|---|
| (37) | 92 | 2 | 2 | 2 | 2 | mixed-phase | 341 |
| (38) | 88 | 3 | 3 | 3 | 3 | mixed-phase | 360 |

TABLE 16

| Aluminum alloy | T.T. Cond. Tem. (°C.) | Time (hr) | C.C. phase Dia. (μm) | Vf (%) | Har. (Hv/DPN) | Ben. (≧0.1) | Estimation |
|---|---|---|---|---|---|---|---|
| (37) | 320 | 1 | 1.5 | 80 | 251 | possible | good |
| (38) | 340 | 1 | 1.0 | 80 | 289 | possible | good |

T.T. Cond. = Thermal treatment condition
C.C. phase = Chrysanthemum-like patterned phase
Har. = Hardness
Ben. = Bending
Tem. = Temperature
Dia. = Diameter
Vf = Volume fraction (h) Al-X-T-Mn-Si Based Alloy (Tables 17 and 18)

TABLE 17

| Alloy blank | Composition (atomic %) Al | Fe | Ni | Co | Zr | Ti | Mm | Mn | Si | Primary structure | Des. Tem. (°C.) |
|---|---|---|---|---|---|---|---|---|---|---|---|
| (39) | 89 | 6 | — | — | 3 | — | — | — | 2 | mixed-phase | 341 |
| (40) | 90 | 6 | — | — | 2 | — | — | — | 2 | mixed-phase | 354 |
| (41) | 90 | 5 | 1 | — | 2 | — | — | — | 2 | mixed-phase | 345 |
| (42) | 90 | 5 | — | 1 | 2 | — | — | — | 2 | mixed-phase | 348 |
| (43) | 91 | 5 | — | — | 2 | — | — | — | 2 | mixed-phase | 394 |

TABLE 17-continued

| Alloy blank | Composition (atomic %) Al | Fe | Ni | Co | Zr | Ti | Mm | Mn | Si | Primary structure | Des. Tem. (°C.) |
|---|---|---|---|---|---|---|---|---|---|---|---|
| (44) | 89 | 6 | — | — | — | 3 | — | — | 2 | mixed-phase | 393 |
| (45) | 90 | 6 | — | — | — | 2 | — | — | 2 | mixed-phase | 386 |
| (46) | 89 | 6 | — | — | 1 | 2 | — | — | 2 | mixed-phase | 395 |
| (47) | 89 | 6 | — | — | — | 2 | 1 | — | 2 | mixed-phase | 370 |
| (48) | 89 | 5 | — | — | — | 3 | — | 1 | 2 | mixed-phase | 391 |
| (49) | 89 | 5 | — | — | 1 | 2 | — | 1 | 2 | mixed-phase | 394 |
| (50) | 89 | 5 | — | — | — | 2 | 1 | 1 | 2 | mixed-phase | 386 |
| (51) | 91 | 5 | — | — | — | 3 | — | — | 1 | mixed-phase | 362 |
| (52) | 90 | 5 | — | — | — | 3 | — | — | 2 | mixed-phase | 394 |
| (53) | 89 | 5 | — | — | — | 3 | — | — | 3 | mixed-phase | 396 |
| (54) | 88 | 5 | — | — | — | 3 | — | — | 4 | mixed-phase | 385 |

Des. Tem. = Destruction temperature

TABLE 18

| Aluminum alloy | T.T. Cond. Tem. (°C.) | Time (hr) | C.C. phase Dia. (μm) | Vf (%) | Har. (Hv/DPN) | Ben. (≧0.1) | Estimation |
|---|---|---|---|---|---|---|---|
| (39) | 320 | 1 | 1.0 | 90 | 276 | possible | good |
| (40) | 330 | 1 | 1.0 | 80 | 265 | possible | good |
| (41) | 325 | 1 | 1.0 | 80 | 270 | possible | good |
| (42) | 325 | 1 | 1.0 | 80 | 260 | possible | good |
| (43) | 375 | 1 | 1.0 | 70 | 251 | possible | good |
| (44) | 370 | 1 | 1.0 | 70 | 268 | possible | good |
| (45) | 365 | 1 | 1.0 | 80 | 245 | possible | good |
| (46) | 375 | 1 | 1.0 | 80 | 268 | possible | good |
| (47) | 350 | 1 | 1.0 | 80 | 266 | possible | good |
| (48) | 370 | 1 | 1.0 | 80 | 281 | possible | good |
| (49) | 375 | 1 | 1.0 | 80 | 288 | possible | good |
| (50) | 365 | 1 | 1.0 | 90 | 265 | possible | good |
| (51) | 345 | 1 | 1.0 | 90 | 245 | possible | good |
| (52) | 375 | 1 | 1.0 | 90 | 252 | possible | good |
| (53) | 375 | 1 | 1.0 | 80 | 264 | possible | good |
| (54) | 365 | 1 | 1.0 | 80 | 260 | possible | good |

T.T. Cond. = Thermal treatment condition
C.C. phase = Chrysanthemum-like patterned phase
Har. = Hardness
Ben. = Bending
Tem. = Temperature
Dia. = Diameter
Vf = Volume fraction An example of production of an alloy blank by application of a casting process will be described below.

A molten base alloy having the same composition as the alloy blank (21) given in Table 9, i.e., represented by $Al_{90}Ni_5Mm_5$ (each of the numerical values represents atomic precentages) was prepared through an arc melting. The base alloy was remelted in a quartz tube by a high frequency heating, and then, the molten metal was poured into a metal mold of copper through a nozzle located at a tip end of the quartz tube and having a diameter of 0.3 mm, thereby producing a thin plate-like alloy blank having a width of 10 mm, a length of 30 mm and a thickness of 1 mm.

X-ray diffraction and differential thermal analysis (DSC) were conducted for the alloy blank, and the results showed that the primary structure of the alloy blank was a mixed-phase structure comprised of an fcc phase and an amorphous phase, and the destruction temperature of the mixed-phase structure was 333° C.

Subsequently, the alloy blank was subjected to a thermal treatment for one hour at 300° C., thereby providing an aluminum alloy.

In this aluminum alloy, the diameter of the chrysanthemum-like patterned phase was 2.0 μm; the volume fraction Vf of the chrysanthemum-like patterned phase was 80%, and the hardness (Hv/DPN) of the aluminum alloy was 223.

It has been ascertained from this result that even if the alloy blank produced in the casting process is used, it is possible to produce an aluminum alloy having a strength equal to that produced when the alloy blank produced by a single-roll process is used.

As another attempt, an aluminum alloy was produced through the following steps: a step of pouring a molten metal ($Al_{90}Ni_5Mm_5$) remelted as described above into the above-described metal mold of copper heated to 300° C. to cast an alloy blank, a step of sequentially retaining the alloy blank within the metal mold at 300° C. for 5 minutes to provide an aluminum alloy, a step of releasing the aluminum alloy from the mold and a step of cooling the aluminum alloy.

In the aluminum alloy produced in this manner, the diameter of the chrysanthemum-like patterned phase was 2.2 μm; the volume fraction Vf of the chrysanthemum-like patterned phase was 75%, and the hardness (Hv/DPN) of the aluminum alloy was 216. It was ascertained that this aluminum alloy had characteristics equal to those of the above-described aluminum alloy subjected to the thermal treatment at a separate step after casting.

If the alloy blank is retained within the metal mold in the above-described manner, it follows that the alloy blank has been subjected to a thermal treatment subsequent to the casting. Therefore, it is possible to reduce the number of steps and the cost for producing the aluminum alloy, as compared with the production of the aluminum alloy using a separate step after casting to thermally treat the alloy.

What is claimed is:

1. A process for producing an aluminum alloy with a high strength and a high toughness, comprising the steps of:

preparing an alloy blank having a primary structure which is one selected from a single-phase structure comprised of a solid-solution phase, a single-phase structure comprised of an amorphous phase, and a mixed-phase structure comprised of a solid-solution phase and an amorphous phase, subjecting the alloy blank to a thermal treatment at a temperature in a range of about 17K–36K below the destruction temperature of the primary structure, and maintaining the thermal treatment until an aluminum alloy is formed which has a secondary structure containing 20% or more by volume fraction Vf of chrysanthemum-shaped phases each having a diameter of at most 5 μm and comprising a solid-solution phase and an intermetallic compound phase arranged radiately.

2. A process for producing an aluminum alloy with a high strength and a high toughness according to claim 1, wherein said alloy blank is represented by a chemical formula:

$$Al_aX_bT_c$$

wherein X is at least one element selected from a first group consisting of Fe, Co, Ni and Cu; T is at least one element selected from a second group consisting of Y, rare earth elements, Zr, Ti, Mm (misch metal) and Ca; and each of a, b and c are atomic percentages, with the proviso that $85 \leqq a \leqq 96$, $1 < b \leqq 12$, and $1 < c \leqq 10$.

3. A process for producing an aluminum alloy with a high strength and a high toughness according to claim 1, wherein said alloy blank is represented by a chemical formula:

$$Al_aX_bT_cZ_d$$

wherein X is at least one element selected from a first group consisting of Fe, Co, Ni, and Cu; T is at least one element selected from a second group consisting of Y, rare earth elements, Zr, Ti, Mm (misch metal) and Ca; Z is at least one element selected from a third group consisting of V, Cr, Mn, Nb and Mo; and each of a, b, c and d are atomic percentages, with the proviso that $85 \leqq a \leqq 96$, $1 < b \leqq 12$, $1 < c \leqq 10$, and $d \leqq 3$.

4. A process for producing an aluminum alloy with a high strength and a high toughness according to claim 1, wherein said alloy blank is represented by a chemical formula:

$$Al_aX_bT_cSi_e$$

wherein X is at least one element selected from a first group consisting of Fe, Co, Ni and Cu; T is at least one element selected from a second group consisting of Y, rare earth elements, Zr, Ti, Mm (misch metal) and Ca; and each of a, b, c and e are atomic percentages, with the proviso that $85 \leqq a \leqq 96$, $1 < b \leqq 12$, $1 < c \leqq 10$, and $e \leqq 4$.

5. A process for producing an aluminum alloy with a high strength and a high toughness according to claim 1, wherein said alloy blank is represented by a chemical formula:

$$Al_aX_bT_cZ_dSi_e$$

wherein X is at least one element selected from a first group consisting of Fe, Co, Ni, Cu; T is at least one element selected from a second group consisting of Y, rare earth elements, Zr, Ti, Mm (misch metal) and Ca; Z is at least one element selected from a third group consisting of V, Cr, Mn, Nb and Mo; and each of a, b, c, d and e are atomic percentages, with the proviso that $85 \leqq a \leqq 96$, $1 < b \leqq 12$, $1 < c \leqq 10$, $d \leqq 3$, and $e \leqq 4$.

* * * * *